US010427907B2

(12) United States Patent
Barnes

(10) Patent No.: US 10,427,907 B2
(45) **Date of Patent: *Oct. 1, 2019**

(54) MULTIPLE HIGH PRESSURE FLEXIBLE LANCE HOSE TAKE UP DRUM

(71) Applicant: STONEAGE, INC., Durango, CO (US)

(72) Inventor: Jeffery R. Barnes, Ignacio, CO (US)

(73) Assignee: STONEAGE, INC., Durango, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/366,879

(22) Filed: Mar. 27, 2019

(65) Prior Publication Data

US 2019/0218058 A1 Jul. 18, 2019

Related U.S. Application Data

(63) Continuation of application No. 15/286,981, filed on Oct. 6, 2016, now Pat. No. 10,336,571.
(Continued)

(51) Int. Cl.
*B65H 75/44* (2006.01)
*F28G 15/02* (2006.01)
(Continued)

(52) U.S. Cl.
CPC ..... *B65H 75/4478* (2013.01); *B65H 57/12* (2013.01); *B65H 57/16* (2013.01);
(Continued)

(58) Field of Classification Search
CPC .. B65H 75/4478; B65H 75/364; B65H 57/16; B65H 57/12; B65H 75/08; B65H 2701/33; F28G 15/02; F28G 1/163; F28G 15/04
See application file for complete search history.

(56) References Cited

U.S. PATENT DOCUMENTS 1,746,995 A 2/1930 Edwards
1,942,388 A 1/1934 Ash
(Continued)

FOREIGN PATENT DOCUMENTS

JP H07-204598 8/1995
WO WO2010/019047 2/2010

OTHER PUBLICATIONS

International Search Report and Written Opinion, dated Jan. 24, 2017, from related International Patent Application No. PCT/US2016/055672.
(Continued)

*Primary Examiner* — William A. Rivera
(74) *Attorney, Agent, or Firm* — Greenberg Traurig, LLP

(57) ABSTRACT

A multiple flexible lance hose take-up drum apparatus or device in accordance with the present disclosure includes a base having three or more support legs and a hollow take-up drum assembly rotatably supported from the base. The drum assembly includes a hollow cylindrical shell, a bottom plate fastened to the shell, a high pressure fluid supply connection and a manifold positioned radially along a bottom plate of the shell for connection to one end of each of a plurality of flexible lance hoses. The base includes an L shaped support arm extending from the bases alongside the shell. A plurality of guide tubes are supported by the support arm and aligned over a rim of the shell for guiding flexible lance hoses into and out of the take-up drum assembly.

20 Claims, 11 Drawing Sheets

Related U.S. Application Data

(60) Provisional application No. 62/243,542, filed on Oct. 19, 2015.

(51) Int. Cl.

| | |
|---|---|
| ***F28G 1/16*** | (2006.01) |
| ***B65H 75/36*** | (2006.01) |
| ***B65H 57/12*** | (2006.01) |
| ***F28G 15/04*** | (2006.01) |
| ***B65H 57/16*** | (2006.01) |
| ***B65H 75/08*** | (2006.01) |

(52) U.S. Cl.

CPC ..... *B65H 75/08* (2013.01); *B65H 75/364* (2013.01); *F28G 1/163* (2013.01); *F28G 15/02* (2013.01); *F28G 15/04* (2013.01); *B65H 2701/33* (2013.01)

(56) References Cited

U.S. PATENT DOCUMENTS

| | | | | |
|---|---|---|---|---|
| 2,334,141 | A | 11/1943 | Zierden | |
| 2,339,901 | A | 1/1944 | Zierden | |
| 2,496,489 | A | 2/1950 | Palm | |
| 2,519,064 | A | 8/1950 | Palm | |
| 2,519,655 | A | 5/1952 | Hannay | |
| 2,871,057 | A | 1/1959 | Bernyk | |
| 2,989,980 | A | 6/1961 | Cullen et al. | |
| 3,612,094 | A | 10/1971 | Hare | |
| 4,132,367 | A | 1/1979 | Ineson et al. | |
| 4,299,249 | A | 11/1981 | Nederman | |
| 4,757,838 | A | 7/1988 | McGullion | |
| 5,022,463 | A | 6/1991 | Boisture | |
| 5,184,636 | A | 2/1993 | Van Der Wade | |
| 5,335,687 | A | 8/1994 | Odom | |
| 5,451,002 | A | 9/1995 | Amuny | |
| 5,787,923 | A | 8/1998 | Shea et al. | |
| 6,807,982 | B1 | 10/2004 | Ames | |
| 6,974,103 | B1 | 12/2005 | Pansini | |
| 7,040,331 | B2 | 5/2006 | Garman et al. | |
| 9,630,801 | B2 | 4/2017 | Barnes | |
| 10,336,571 | B2 * | 7/2019 | Barnes | B65H 75/4478 |
| 2001/0009162 | A1 | 7/2001 | Francis | |
| 2004/0069331 | A1 | 4/2004 | Garman et al. | |
| 2013/0299621 | A1 | 11/2013 | Zink | |
| 2015/0068563 | A1 | 3/2015 | Gzym et al. | |
| 2016/0023264 | A1 | 1/2016 | Barnes | |

OTHER PUBLICATIONS

Supplementary European Search Report, dated May 20, 2019, from related European Patent Application No. 16857990.2.

* cited by examiner

MULTIPLE HIGH PRESSURE FLEXIBLE LANCE HOSE TAKE UP DRUM

CROSS REFERENCE TO RELATED APPLICATIONS

This application is a continuation of U.S. patent application Ser. No. 15/286,981 filed Oct. 6, 2016, which claims the benefit of priority of U.S. Provisional Patent Application Ser. No. 62/243,542 filed Oct. 19, 2015, entitled Multiple High Pressure Flexible Lance Hose Take Up Drum, the content of each of which is incorporated by reference herein in its entirety.

BACKGROUND OF THE DISCLOSURE

The present disclosure is directed to high pressure fluid handling systems. In particular, embodiments of the present disclosure are directed to an apparatus for collecting and supplying two or more flexible tube cleaning lances from and to a drive apparatus for inserting and withdrawing the lances from tubes within a heat exchanger tube bundle, or other multiple pipe or tubing arrangements while maintaining an orderly arrangement of the hoses.

One conventional tube lancing apparatus consists of a rotating reel flexible lance hose take-up and hose dispensing apparatus that carries a predetermined length of flexible lance hose wrapped around the exterior of a drum. The drum is rotated by an air motor to push the flexible lance or lances off of the drum and into one or two heat exchanger tubes. This drum apparatus necessarily must be somewhat remotely located from the heat exchanger tube sheet in order to accommodate the size of the drum and the air drive apparatus.

With the advent of small flexible lance drive apparatuses designed to be mounted directly to a heat exchanger tube sheet such as the drive apparatus disclosed in U.S. patent application Ser. No. 14/693,259, filed Apr. 22, 2015, the flexible lance hoses typically lie in disarray on the floor around the drive apparatus. They can become tangled together such that smooth feed may be disrupted. Hence there is a need for a storage and transfer apparatus that can accommodate two or more hoses equally while maintaining orderly storage of the multiple flexible lance hoses.

SUMMARY OF THE DISCLOSURE

A multiple flexible lance hose take-up drum apparatus or device in accordance with the present disclosure directly addresses such needs. One embodiment of a flexible lance take-up drum apparatus in accordance with the present disclosure includes a take-up drum apparatus for a plurality of flexible lance hoses. The apparatus includes a base having three or more support legs and a hollow take-up drum assembly rotatably supported from the base.

The drum assembly includes a hollow cylindrical shell, a bottom plate fastened to the shell, a high pressure fluid supply connection and a manifold positioned radially along a bottom plate of the shell for connection to one end of each of a plurality of flexible lance hoses. One embodiment of the base includes an L shaped support arm extending from the bases alongside the shell. A plurality of guide tubes are supported by the support arm and aligned over a rim of the shell for guiding flexible lance hoses into and out of the take-up drum assembly.

One embodiment of a take-up drum apparatus for a plurality of flexible high pressure fluid cleaning lance hoses in accordance with the present disclosure includes a base, and a hollow take-up drum assembly rotatably supported from the base via a rotary swivel. The drum assembly includes a hollow cylindrical shell having a bottom plate, a cylindrical side wall, a high pressure fluid supply connection and a manifold positioned on the bottom plate of the shell for connection of one end of each of a plurality of flexible lance hoses to the high pressure fluid supply connection. The base includes a support arm extending from the base extending outside of and across the side wall of the shell. One or more guide tubes are supported by the support arm and are positioned so as to guide flexible lance hoses into and out of the take-up drum assembly.

The base has a central socket for receiving a portion of the swivel and a set of three or more legs supporting the socket. The swivel further has a bearing supported tubular shaft in a housing that forms a stem adapted to be carried in the socket of the base. The bottom plate has a hub fastened to the tubular shaft of the swivel. The high pressure fluid supply connection is fastened to a stem of the swivel mounted in the socket. The take-up drum shell has a peripheral rim parallel to the bottom plate. The drum assembly further preferably includes an inverted U shaped tube connecting the swivel to the manifold in the shell.

An embodiment of a take-up drum apparatus in accordance with the present disclosure for receiving, storing and dispensing a plurality of high pressure cleaning fluid hoses to and from a flexible lance drive apparatus includes a base having three or more legs radiating from a central socket and a support arm extending from one of the legs and a hollow take-up drum assembly rotatably supported from the base by a rotary swivel.

The drum assembly includes a hollow cylindrical shell having a cylindrical side wall merging with a bottom plate having a central hub. The shell has a peripheral annular rim around the side wall parallel to the bottom plate. A manifold block is fastened to the bottom plate of the shell for connection of one end of each of a plurality of flexible lance hoses to a high pressure fluid supply connector through the swivel. The assembly includes one or more flexible lance guide tubes carried by the support arm and directed by the support arm tangent to the cylindrical shell.

Further features, advantages and characteristics of the embodiments of this disclosure will be apparent from reading the following detailed description when taken in conjunction with the drawing figures.

DETAILED DESCRIPTION

Figure 1:
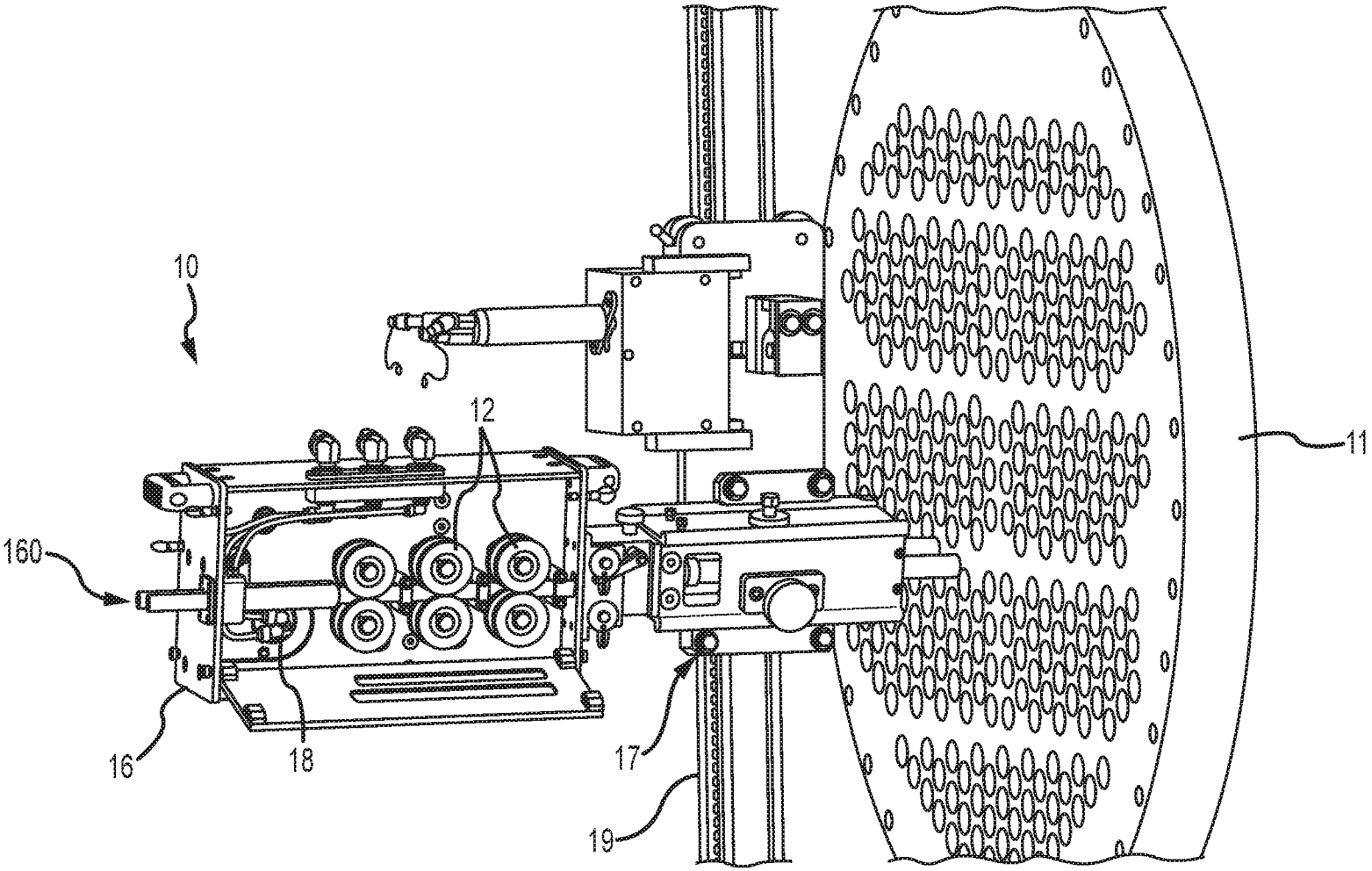
FIG. 1 is a perspective view of a flexible lance drive apparatus fastened to a frame adjacent a heat exchanger tube sheet.

An exemplary flexible lance drive apparatus 10 is shown in FIG. 1 with a side cover open showing the set of 3 pairs of drive rollers 12 arranged for driving two flexible high pressure lance hoses 160. The apparatus 10 includes a housing 16 in which a drive motor 18 drives each of the six drive rollers 12. FIG. 1 shows a drive apparatus 10 supported for guiding one or more flexible lance hoses 160 into and out of a tube in a heat exchanger tube sheet 11. The drive apparatus 10 is typically mounted on a flexible lance guide 17 which is fastened to a frame 19 that places the drive apparatus 10 in alignment with the tubes penetrating the tube sheet 11.

Figure 2:
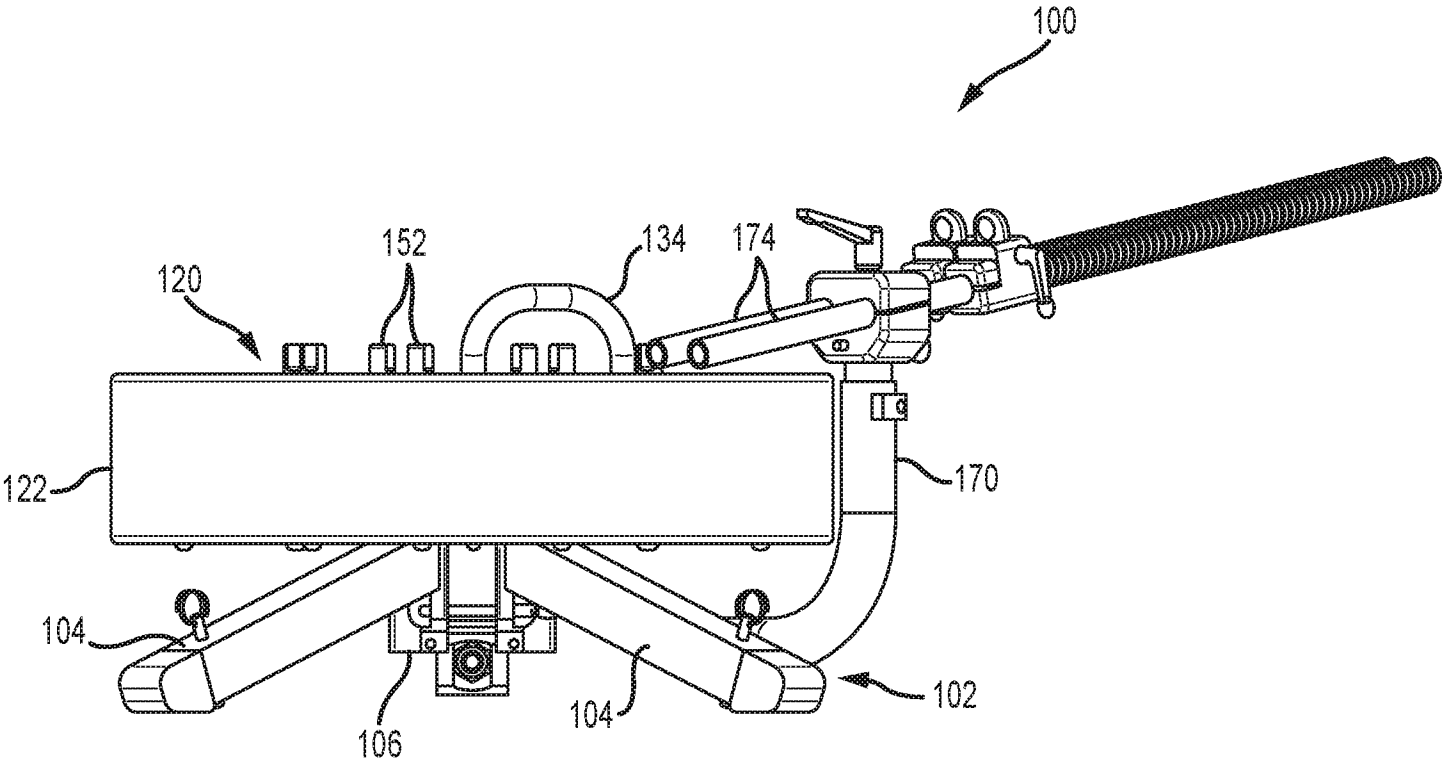
FIG. 2 is a side view of one embodiment of a flexible lance take-up drum apparatus in accordance with the present disclosure.

An exemplary take-up drum apparatus 100 in accordance with a first embodiment of the present disclosure is designed to dispense and take up flexible lance hoses 160 as they are supplied to or withdrawn from a piping system being cleaned, such as tubes in the heat exchanger 11 shown in FIG. 1. An exemplary embodiment of the take-up drum apparatus 100 is shown in a side view in FIG. 2. The apparatus consists of a base 102 having three or four legs 104 for resting the apparatus on a generally flat surface (not shown), and a take-up drum assembly 120 rotatably supported in a central recess or socket 106 of the base 102.

Figure 3:
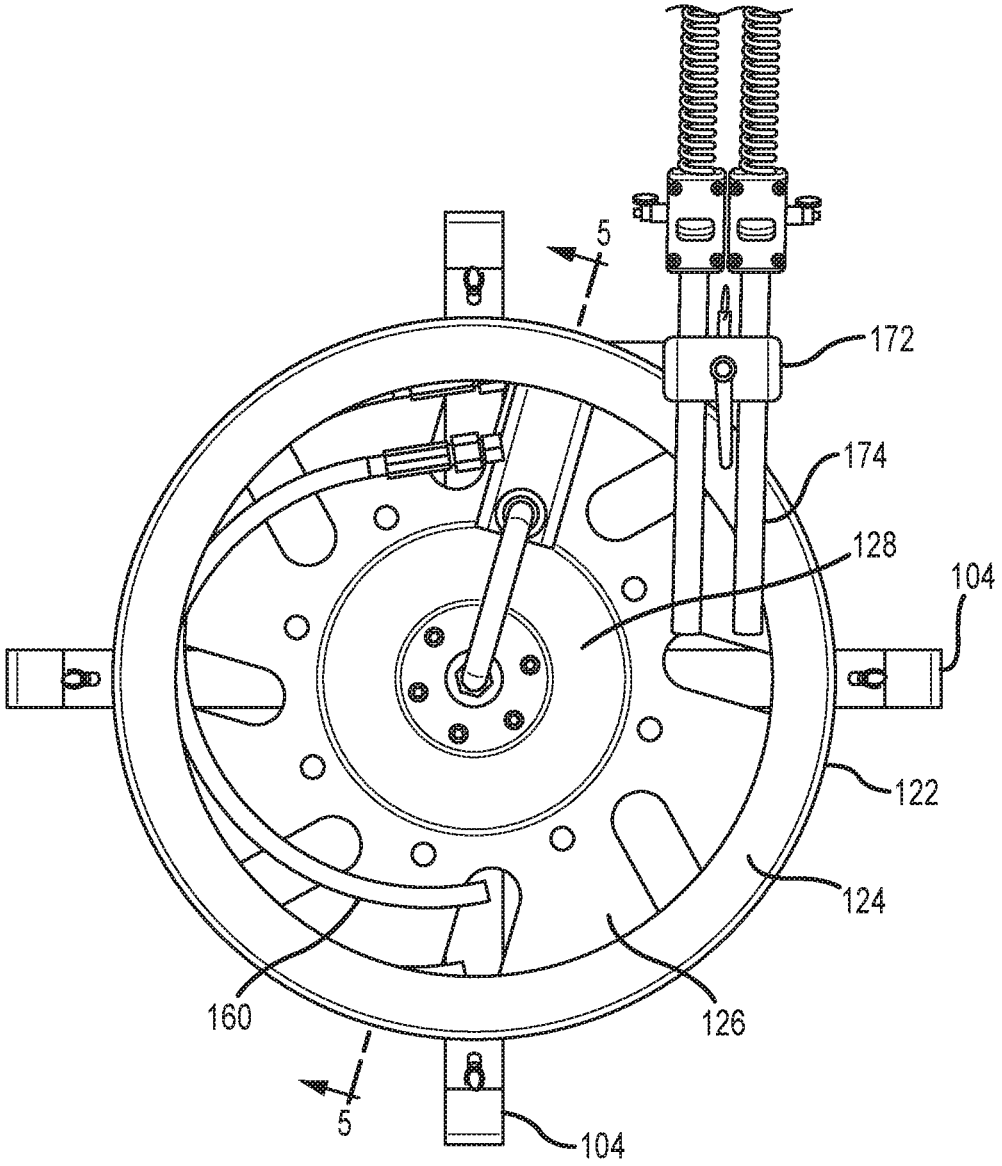
FIG. 3 is a top plan view of the apparatus shown in FIG. 2.
Figure 4:
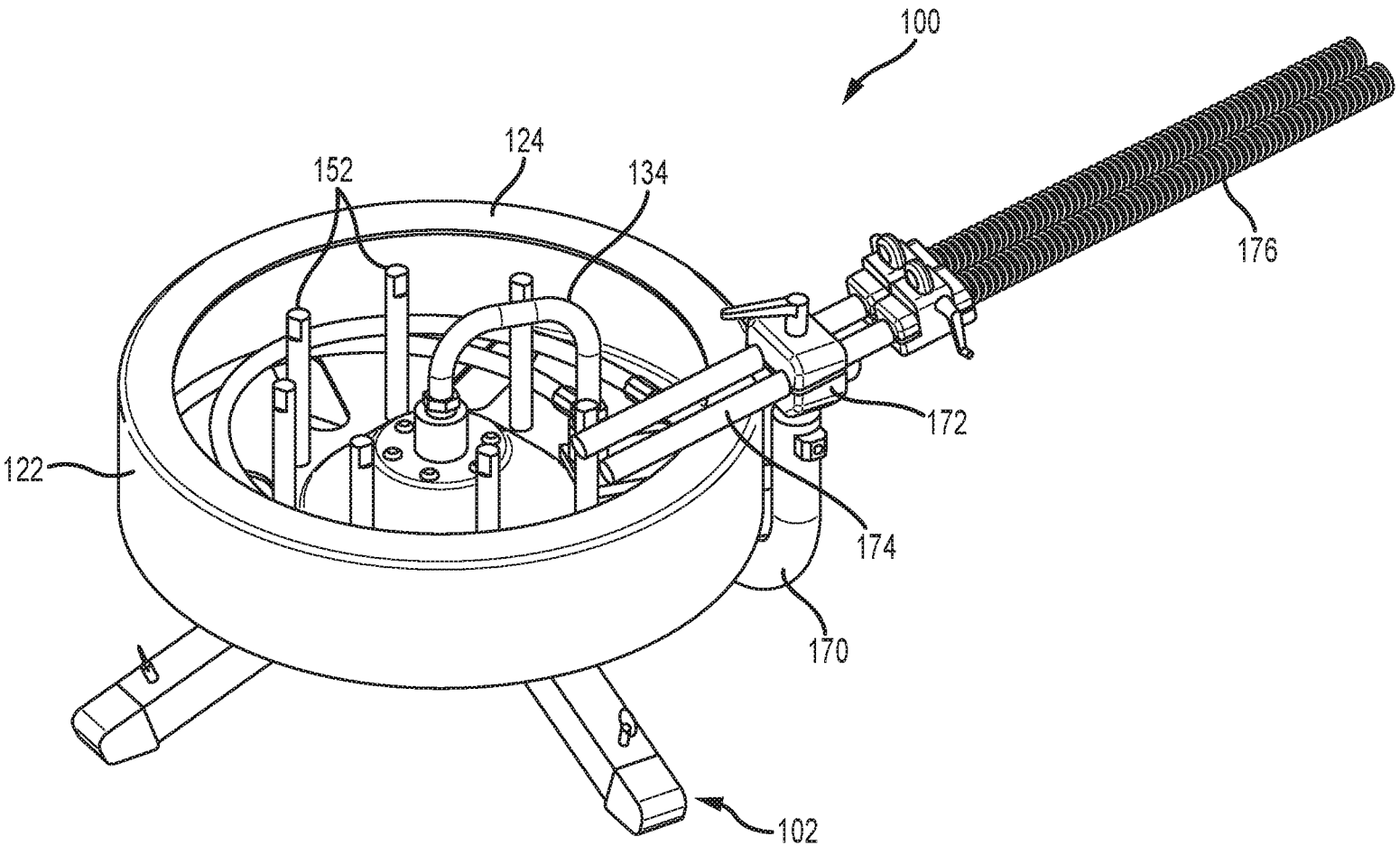
FIG. 4 is an upper perspective view of the apparatus shown in FIG. 2.
Figure 5:
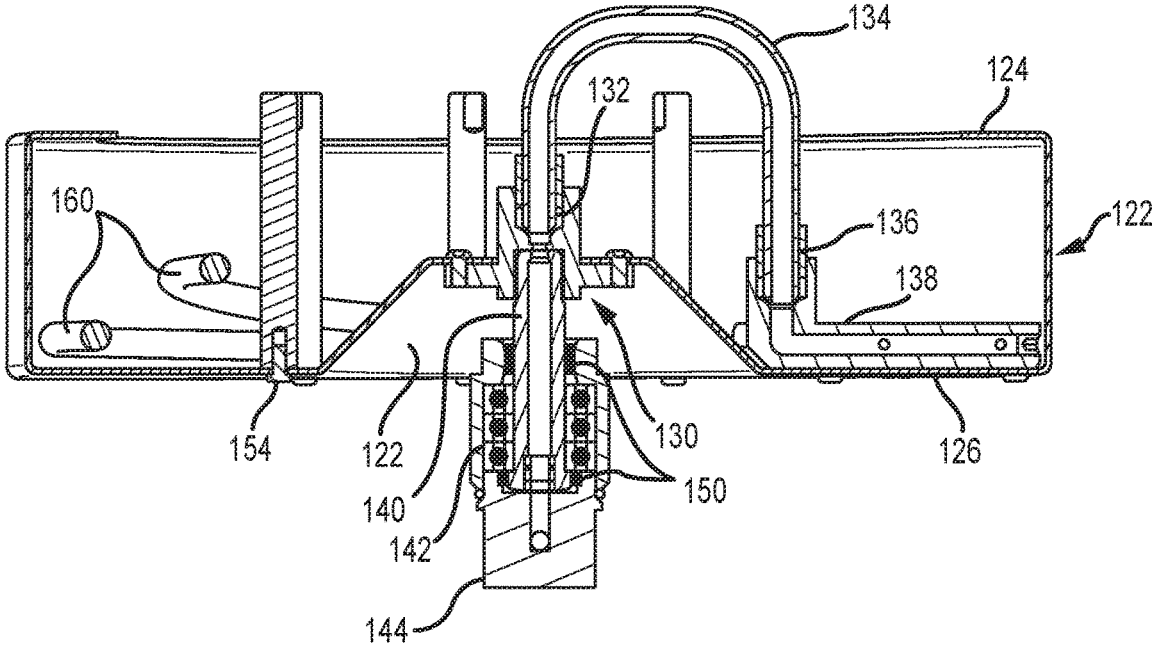
FIG. 5 is a cross sectional view of the apparatus taken on the line 5-5 in FIG. 3.
Figure 6:
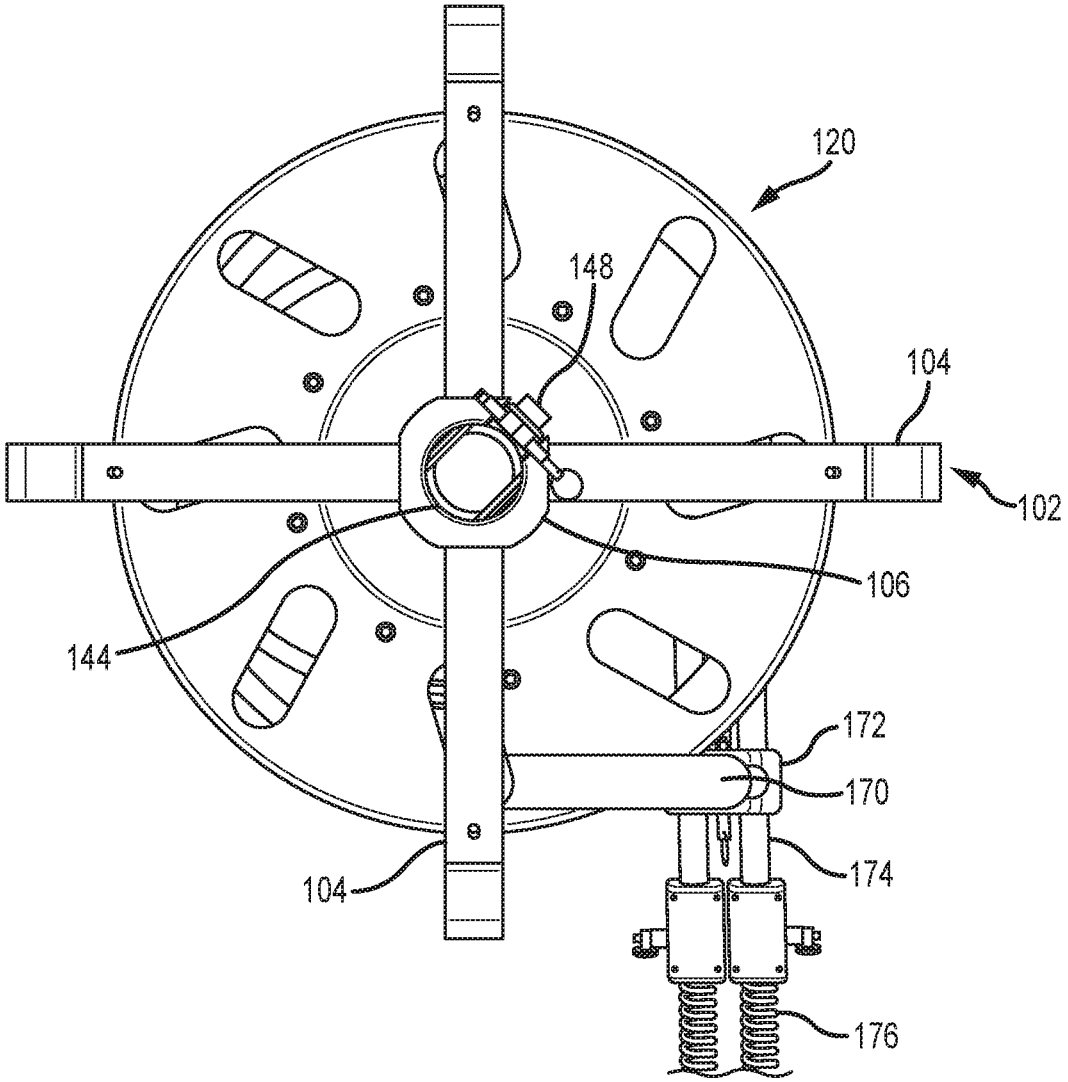
FIG. 6 is a bottom plan view of the apparatus shown in FIG. 2.

The drum assembly 120 has a hollow cylindrical outer shell 122 with an upper annular rim 124 and an annular disc shaped bottom plate 126 as seen in FIG. 3. The annular rim 124 extends around the shell 122 parallel to the bottom plate 126. The disc shaped bottom plate is bolted to the base of a central truncated conical hub 128. The top of the truncated conical hub 128 is fastened to a tubular shaft 140 of a high pressure swivel 130. The shaft 140 of the swivel 130 is threaded to one end 132 of an inverted U shaped tube 134. The opposite end 136 of the tube 134 is threaded into a radially extending manifold 138 that is fastened to the bottom plate 126. The central truncated conical hub 128 and the tubular shaft 140 of the swivel 130 rotate with the shell 122 about a vertical axis through the swivel 130. The tubular shaft 140 of the swivel 130 is carried by bearings 142 in a stem 144 that slides vertically into the socket 106 of the support base 102. This stem 144 has a central passage 146 that communicates with a hose fitting 148, shown in FIG. 6, for connecting a high pressure water source to the apparatus 100.

When the stem 144 of the swivel 130 is inserted into the socket 106 of the support base 102, the stem 144 is captured therein and the stem 144 does not rotate. Instead, the tubular shaft 140 of the swivel 130 rotates in the bearings 142. High pressure seals 150 at the top and bottom of the shaft 140 of the swivel 130 prevent water leakage and seal the bearings 142 from fluid pressure.

Preferably a series of axially extending guide posts 152 are spaced around the interior of the shell 122 and extend upward from the bottom plate 126. These posts 152 serve as hose guides and may be elongated nuts threaded onto bolts 154 joining the hub 128 to the bottom plate 126. These guide posts 152 may be replaced by a sheet metal sleeve or other guide structure to ensure that the hoses 160 are stored or wrapped around the internal periphery of the shell 122.

The radial manifold 138 fastened to the bottom plate 126 serves as an attachment point for one end of each of the two or more flexible lance hoses 160. The other end of each of the flexible lance hoses 160 extends out of the apparatus 100 and feeds into the high pressure flexible lance drive apparatus 10.

The base 102 of the apparatus 100 is stationary. The base 102 has an L shaped support arm 170 that has one end fastened to one of the legs 104. This support arm 170 extends laterally out from the leg 104 beyond the shell 122 and curves up alongside the cylindrical shell 122 to a position just above and tangent to the rim 124. A hose guide tube support 172 is fastened to the distal end of the support arm 170 and carries two or more hose guide stub tubes 174 oriented tangent to the shell 122. The hoses 160 are each routed through one of these hose guide stub tubes 174 into a protective sleeve 176 that is connected to a lance drive apparatus such as the lance drive apparatus 10 shown in FIG. 1.

This protective sleeve 176 primarily confines the path that the lance hose 160 can take as it is withdrawn by the lance drive apparatus 10 from tubes or other piping being cleaned. By confining the path of the hose 160 to the take-up drum 120 of the apparatus 100, the sleeve essentially pushes the hose 160 into and through the guide stub tubes 174 and into the shell 122. This hose movement is what causes the shell 122 and the hub 106 of the drum assembly 120 to rotate on the bearings 142 such that the hose is uniformly deposited into the shell 122. This protective sleeve 176 may also be configured to direct pneumatic and/or electric power to the flexible lance drive apparatus.

During operation, high pressure lance hoses 160 that are being withdrawn from tubes being cleaned are fed by the drive apparatus back through the sleeve 176, the stub tubes 174, and into the shell 122 of the take-up apparatus 100. The drum assembly 120 is thus pushed around by the advancing hoses 160 into the shell 122 and wrap cleanly around the inside of the shell 122. The guide posts 152 help ensure that the hoses 160 do not cross over the hub 128 and instead wrap around the inside of the shell 122.

The manifold 138 may be configured to accept one, two, or a number of hoses. Thus, two, three, four or more hoses 160 may be connected to the manifold 138 and simultaneously extracted or returned to the take-up drum apparatus 100 as above described. A drive motor (not shown) may be added to rotate the hollow drum assembly 120 if needed for a particular application.

Figure 7:
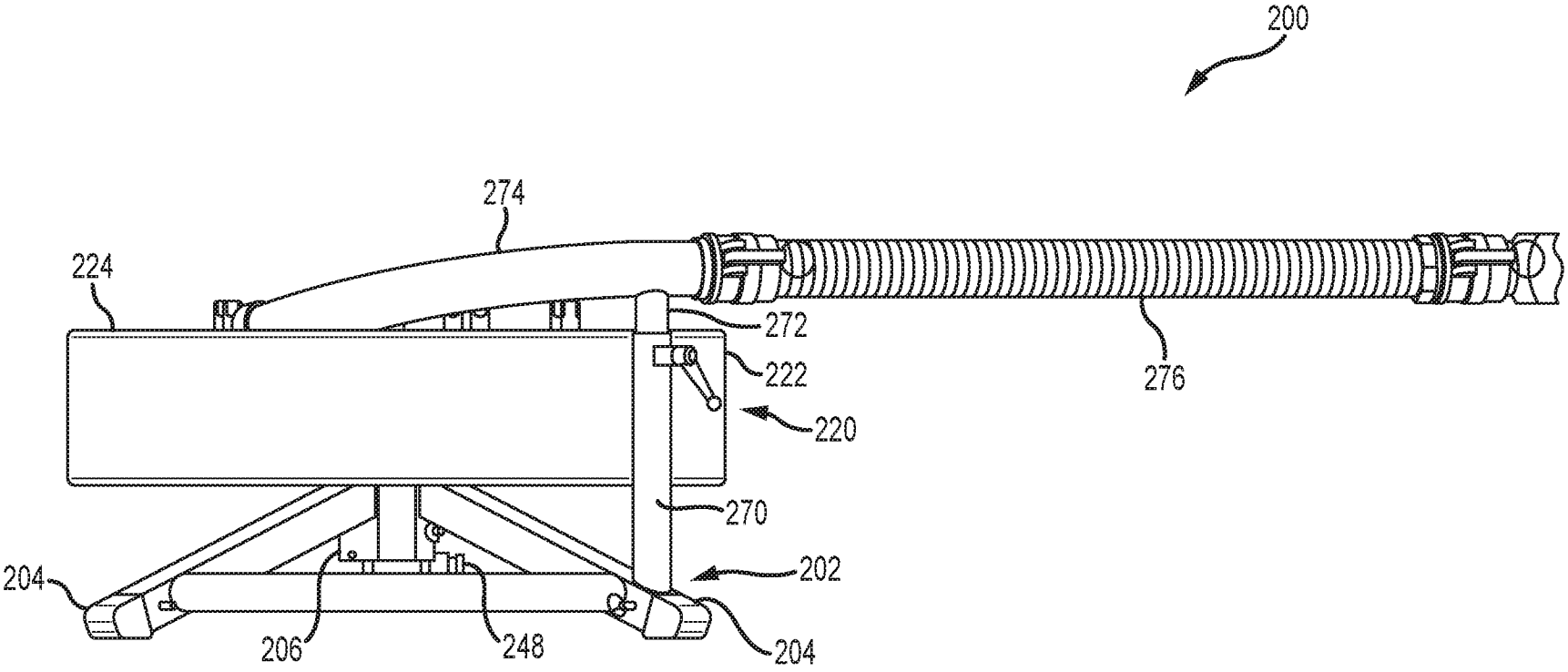
FIG. 7 is a side view of another embodiment of a flexible lance take-up drum apparatus in accordance with the present disclosure.

An exemplary take-up drum apparatus 200 in accordance with a second embodiment of the present disclosure for handling three flexible lance hoses simultaneously is shown in a side view in FIG. 7. The apparatus 200 includes a base 202 having three or four legs 204 for resting the apparatus 200 on a generally flat surface (not shown), and a take-up drum assembly 220 rotatably supported in a central recess or socket 206 of the base 202. This socket 206 may be a C shaped tubular sleeve welded or otherwise firmly attached to the legs 204.

Figure 8:
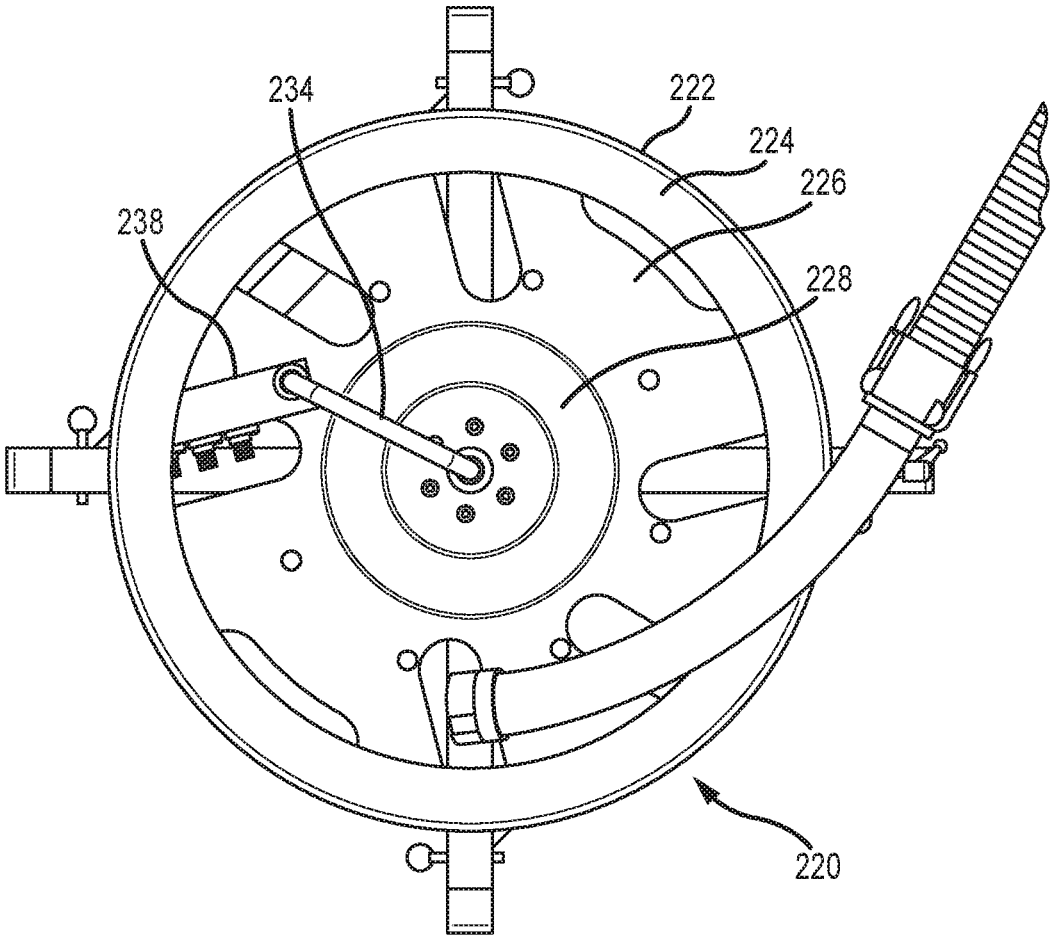
FIG. 8 is a top plan view of the apparatus shown in FIG. 7.
Figure 9:
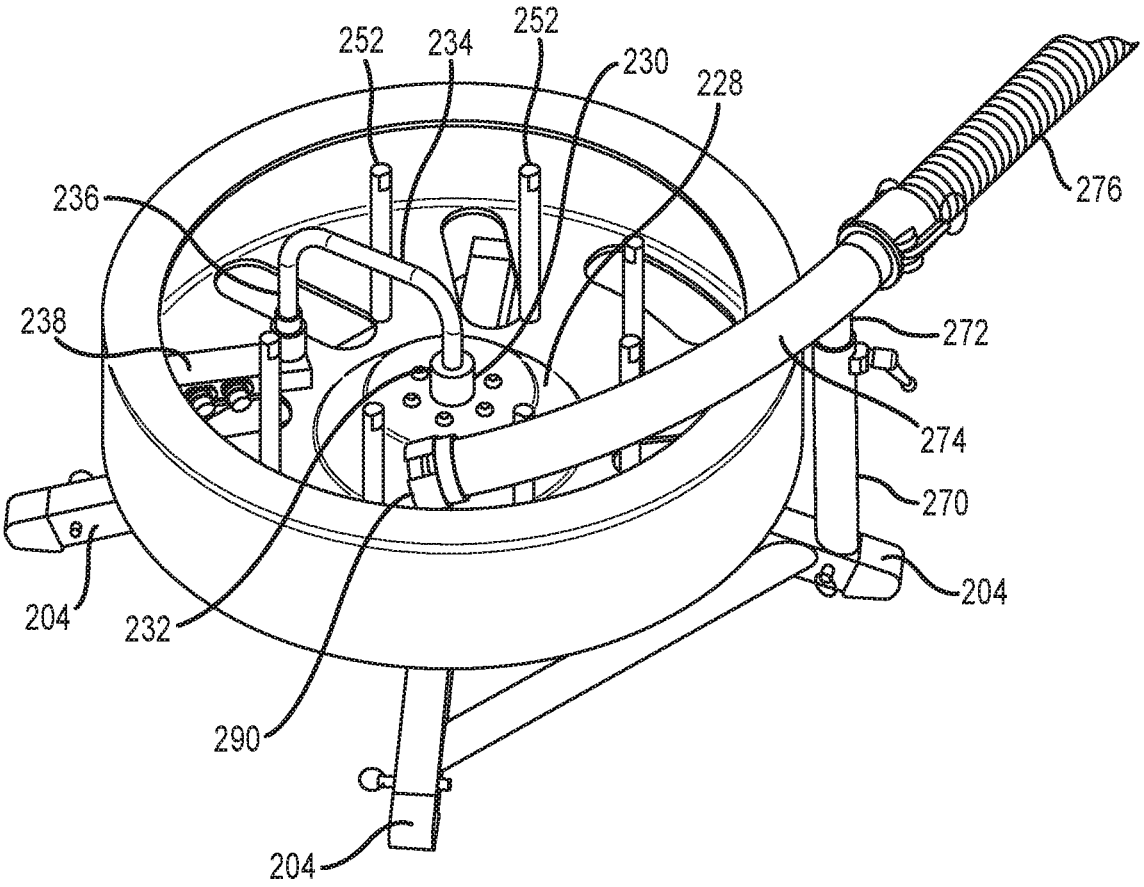
FIG. 9 is an upper perspective view of the apparatus shown in FIGS. 7 and 8.

The drum assembly 220 includes a hollow cylindrical outer shell 222 with an upper annular rim 224 and an integral disc shaped bottom plate 226 as seen in FIG. 8. The disc shaped bottom plate 226 preferably has a central truncated conical hub 228. The top of the truncated conical hub 228 is fastened to an upper end of a tubular shaft 240 of a high pressure rotary swivel 230. The upper portion of the swivel 230 is a tubular shaft 240 which is threaded to one end 232 of an inverted U shaped tube 234. The opposite end 236 of the tube 234 is threaded into a radially extending manifold 238 that is fastened to the bottom plate 226. This manifold 238 has pipe nipple connections for connection to three hoses 260.

The central truncated conical hub 228 and shaft 240 of the rotary swivel 230 rotate with the shell 222 about a vertical axis through the swivel 230 on the bearing supported tubular shaft 240 of the swivel 230. This shaft 240 of the joint 230 is carried by bearings 242 in a stem 244 that slides vertically into the socket 206 of the support base 202. This stem 244 has a central passage 246 that communicates with a hose fitting 248, shown in FIG. 6, for connecting a high pressure water source to the apparatus 200.

When the stem 244 of the swivel 230 is inserted into the socket 206 of the support base 202, the stem 244 is captured therein and the stem 244 does not rotate. Instead, the tubular shaft 240 of the joint 230 rotates in the bearings 242. High pressure seals 250 at the top and bottom of the shaft 240 of the joint 230 prevent water leakage and seal the bearings 242 from fluid pressure.

Preferably a series of axially extending guide posts 252 spaced radially inward from the rim 224 extend upward from the bottom plate 226. These posts 252 serve as internal hose guides around which the three hoses wrap inside the outer shell 222. The radial manifold 238 fastened to the bottom plate 226 serves as an attachment point for either one end of each of three flexible lance hoses 260 or one end of each of three flexible stub hoses which are in turn fastened to the lance hoses 260. The other end of each of the flexible lance hoses 160 (not shown in FIGS. 7-11) extends out of the apparatus 200 and feeds into the hose drive apparatus 10.

The base 202 of the apparatus 200 is preferably stationary and oriented such that the drum assembly 220 can rotate about a vertical axis through the socket 206 of the base 202. This socket 206 essentially is a stationary C shaped sleeve sized for receiving the stem 244. The base 202 has an L shaped support arm 270 that has one end fastened to one of the legs 204. This support arm 270 extends laterally out from the leg 204 beyond the shell 222 and up alongside the cylindrical shell 222 to a position just above the rim 224. A hose guide tube support 272 is telescopically fastened into the distal end of the support arm 270. This support 272 joins and supports a curved guide tube 274 sized to carry three hoses 160 oriented essentially tangent to the inside of the shell 222. The hoses 160 are each routed out of the shell 222 through the hose guide tube 274 into a protective sleeve snout 276. The opposite end of the snout 276 is fastened to the inlet side of the lance drive apparatus 10.

This protective sleeve snout 276 primarily confines the path that the three lance hoses 260 can take as they are withdrawn by the lance drive apparatus 10 from tubes or other piping being cleaned, and vice versa. By confining the path of the hoses 260 to the take-up drum 220 of the apparatus 200, the sleeve or snout 276 essentially pushes the hoses 260 into and through the guide tube 274 and into the shell 222. This hose movement is what causes the shell 222 and the tubular shaft 240 of the rotary swivel 230 of the drum assembly 220 to rotate on the bearings 242 such that the hoses 160 are deposited into the shell 222 around its periphery in an orderly and consistent manner. As in the first embodiment shown and described above with reference to FIGS. 2-6, this protective snout 276 may also be configured to direct pneumatic and/or electric power to the flexible lance drive apparatus 10.

During operation of apparatus 200, high pressure lance hoses 160 that are being withdrawn from tubes being cleaned are fed by the drive apparatus 10 back through the sleeve 276, the stub tube 274, and into the shell 222 of the take-up apparatus 200. The drum assembly 220 is thus pushed around by the advancing hoses 160 into the shell 222 such that the hoses 160 wrap cleanly around the inside of the shell 222. The guide posts 252 help ensure that the hoses 160 do not cross over the hub 228 and instead wrap around the inside of the shell 222. Conversely, when the drive motor withdraws the lance hoses 160, the drum assembly 220 rotates oppositely to permit the hoses 160 to exit through the guide tube 274 into the snout 276.

Figure 10:
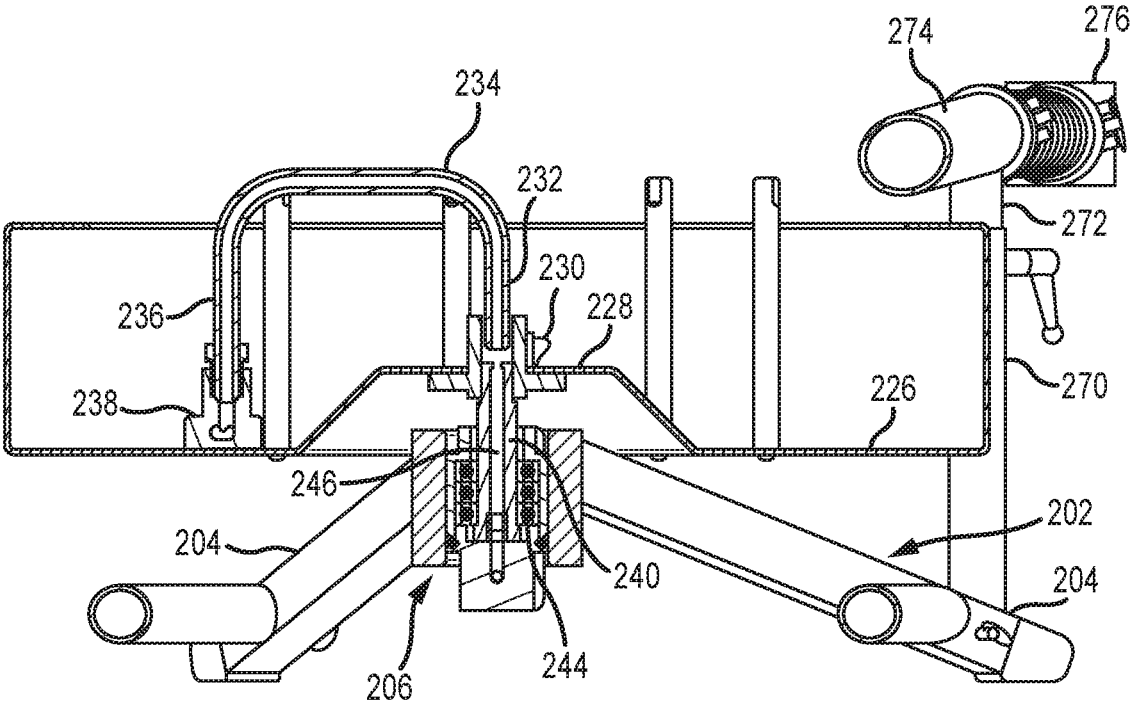
FIG. 10 is a cross sectional view of the apparatus taken on the line 5-5 in FIG. 3.
Figure 11:
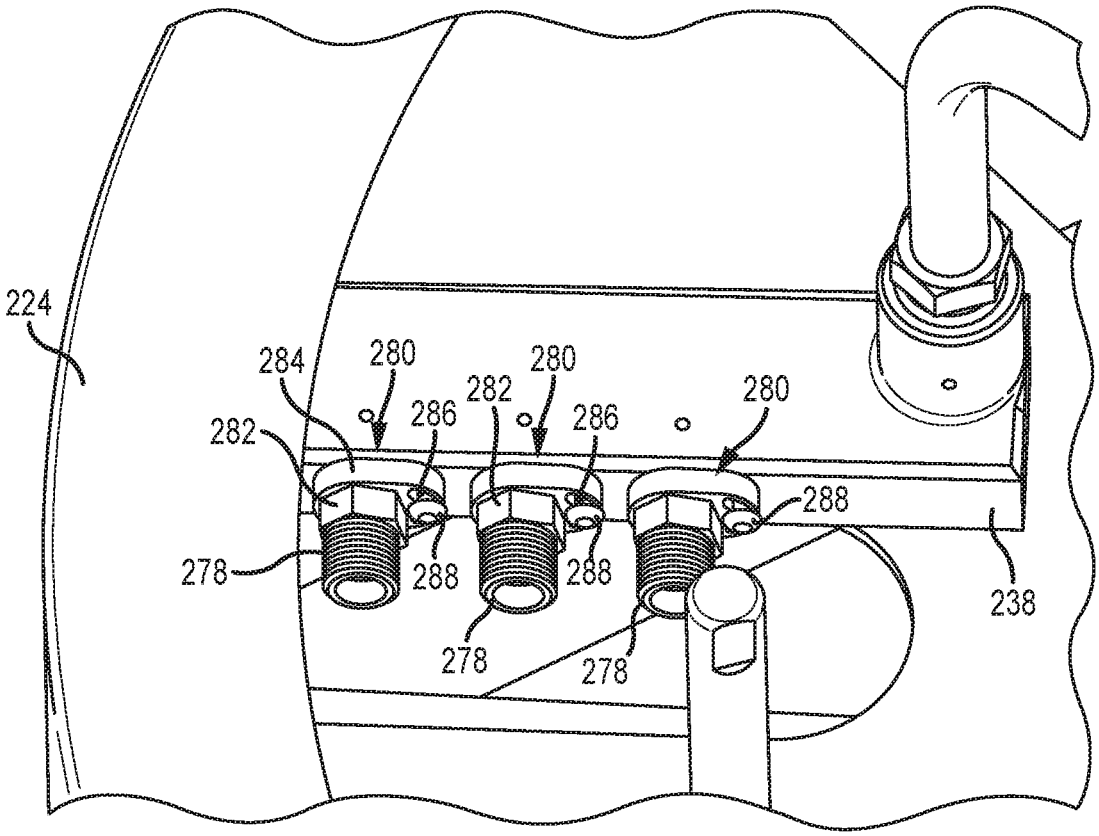
FIG. 11 is an enlarged perspective view of the hose manifold in the apparatus shown in FIG. 7.

Referring now specifically to FIG. 10, a close-up view of the hose manifold 238 is shown, which supports three hose nipples 278 fastened into the manifold 238. Each of these nipples 278 has a novel fitting lock 280 slidably lodged around each nut portion 282 of each of the nipples 278. Each fitting lock 280 is an elongated flat plate 284 with a hexagonal passage therethrough sized to receive the nut portion 282 of the nipple 278 therethrough and a separate closed slot 286 through which a locking screw 288 fastens the lock plate 284 to the manifold 238. The lock 280 prevents the nipple 278 from rotating thus ensuring that the hose nipple 278 is securely fastened to the manifold 238. In order to remove one of the nipples 278, first the screw 288 must be removed and the lock plate 284 slipped off of the nipple 278. The length of the closed slot 286 is sized to accommodate a ⅙ turn of the nipple 278 so that a pre-drilled hole for the screw 288 will align somewhere within the slot 286.

The apparatuses 100 and 200 are scalable such that additional hoses may be simultaneously accommodated, limited mainly by the hose capacity of the hose drive apparatus 10. If less than three hoses are utilized in the apparatus 200, a suitable plug must be installed on the hose nipple 278 for the missing hose.

Preferably the snout 276 has a bushing 290 installed at its proximal end that separates and guides each of the three hoses as they enter and exit the snout 276. This bushing also is sized so as to freely pass hose but stop a lance end, stinger, or nozzle from passing into the drum assembly 220. Similarly, this bushing 290 also interacts with a hose stop (not shown) clamped to each of the hoses to limit the amount of or length of hose that may be withdrawn from the drum assembly 220.

Many changes may be made to the apparatuses 100 and 200 without departing from the scope of the disclosure. For example, the drum shell side wall 122, 222, rim 124, 224, bottom plate 126, 226 and hub 128, 228 may be fabricated from a single sheet metal of polymer material rather than separate structures fastened together. The hose guide posts 152, 252 may be replaced with a circular inner sheet metal wall fastened to the bottom plate 126, 226. The base 102 may be designed to be supported by any rigid structure or surface, not just a flat floor. For example, one or more of the legs 104 of the base 102 may be clamped to a rail or pre-existing frame member near an object to be cleaned via operation of a lance hose 160 and drive apparatus 10 rather than having the three legs resting on a floor. Finally, in close quarter applications the take-up drum apparatus 100 or 200 could be directly fastened to the drive apparatus such as drive 10 rather than requiring a snout 176 as shown. Therefore, all such changes, alternatives and equivalents in accordance with the features and benefits described herein, are within the scope of the present disclosure. Such changes and alternatives may be introduced without departing from the spirit and broad scope of this disclosure as defined by the claims below and their equivalents.

What is claimed is:

1. A take-up drum apparatus for one or more flexible high pressure fluid cleaning lance hoses comprising:

a base;

a hollow take-up drum assembly rotatably supported from the base via a rotary swivel, wherein the drum assembly includes a hollow cylindrical shell having a bottom plate, a cylindrical side wall, a high pressure fluid supply connection and a manifold positioned on the bottom plate of the shell for connection of one end of each of one or more flexible lance hoses to the high pressure fluid supply connection;

a support arm extending from the base outside of and across the side wall of the shell; and one or more guide tubes supported by the support arm for guiding flexible lance hoses into and out of the take-up drum assembly.

2. The apparatus according to claim 1 wherein the base comprises a central socket for receiving a portion of the swivel and a set of three or more legs supporting the socket.

3. The apparatus according to claim 1 wherein the high pressure fluid supply connection is fastened to a stem of the swivel mounted in the socket.

4. The apparatus according to claim 1 wherein the take-up drum shell has a peripheral rim parallel to the bottom plate.

5. The apparatus according to claim 1 further comprising an inverted U shaped tube connecting the swivel to the manifold in the shell.

6. The apparatus according to claim 5 wherein the swivel comprises a bearing supported tubular shaft in a housing forming a stem adapted to be carried in the socket of the base.

7. The apparatus according to claim 6 wherein the bottom plate has a hub fastened to the tubular shaft of the swivel.

8. The apparatus according to claim 1 wherein the base has a central socket receiving a portion of the swivel, a plurality of legs radially extending from the socket, and the support arm positions the one or more guide tubes tangent to the cylindrical shell of the drum assembly.

9. The apparatus according to claim 8 wherein the swivel has a tubular shaft fastened to a hub on the bottom plate of the drum assembly and an inverted U shaped tube extends axially from the tubular shaft and radially to the manifold fastened to the bottom plate.

10. The apparatus according to claim 8 wherein the hub has a truncated conical shape.

11. A take-up drum apparatus for receiving, storing and dispensing one or more high pressure cleaning fluid hoses to and from a flexible lance drive apparatus, the drum apparatus comprising:

a base having three or more legs radiating from a central socket and a support arm extending from one of the legs;

a hollow take-up drum assembly rotatably supported from the base by a rotary swivel, wherein the drum assembly includes a hollow cylindrical shell having a cylindrical side wall merging with a bottom plate having a central hub, a peripheral annular rim around the side wall parallel to the bottom plate, and a manifold fastened to the bottom plate of the shell for connection to one end of one or more flexible lance hoses to a high pressure fluid supply connector through the swivel; and one or more guide tubes carried by the support arm and directed tangent to the cylindrical shell.

12. The apparatus according to claim 11 wherein the high pressure fluid supply connection is fastened to a stem of the swivel mounted in the socket.

13. The apparatus according to claim 11 further comprising an inverted U shaped tube connecting the swivel to the manifold in the shell.

14. The apparatus according to claim 13 wherein the swivel comprises a bearing supported tubular shaft in a housing forming a stem adapted to be carried in the socket of the base.

15. The apparatus according to claim 14 wherein the shaft is fastened to one end of the inverted U shaped tube.

16. The apparatus according to claim 14 wherein the bottom plate has a hub fastened to the tubular shaft of the swivel.

17. The apparatus according to claim 11 wherein the swivel has a tubular shaft fastened to a hub on the bottom plate of the drum assembly and an inverted U shaped tube extends axially from the tubular shaft and radially to the manifold fastened to the bottom plate.

18. The apparatus according to claim 17 wherein the hub has a truncated conical shape.

19. A high pressure flexible lance cleaning apparatus comprising:

a pneumatic drive motor operating a plurality of drive rollers to move one or more flexible lance hoses into and out of a conduit to be cleaned; and a take-up drum apparatus for receiving, storing and dispensing each of the one or more flexible lance hoses to and from the drive apparatus, the drum apparatus comprising:

a base having three or more legs radiating from a central socket and a support arm extending from one of the legs;

a hollow take-up drum assembly rotatably supported from the base by a rotary swivel, wherein the drum assembly includes a hollow cylindrical shell having a cylindrical side wall merging with a bottom plate having a central hub, a peripheral annular rim around the side wall parallel to the bottom plate, and a manifold fastened to the bottom plate of the shell for connection of one end of each of the one or more flexible lance hoses to a high pressure fluid supply connector through the swivel;

one or more guide tubes carried by the support arm and directed tangent to the cylindrical shell; and a protective sleeve snout adapted to be connected between the one or more guide tubes and the drive motor for confining a path of the one or more lance hoses between the drum assembly and the drive motor.

20. The apparatus according to claim 19 wherein the high pressure fluid supply connection is fastened to a stem of the swivel mounted in the socket.

* * * * *